US007511593B2

(12) United States Patent
Ballard

(10) Patent No.: US 7,511,593 B2
(45) Date of Patent: Mar. 31, 2009

(54) DVI-COMPATIBLE MULTI-POLE DOUBLE-THROW MECHANICAL SWITCH

(75) Inventor: Clinton L Ballard, Suquamish, WA (US)

(73) Assignee: eAcceleration Corporation, Poulsbo, WA (US)

( * ) Notice: Subject to any disclaimer, the term of this patent is extended or adjusted under 35 U.S.C. 154(b) by 281 days.

(21) Appl. No.: 11/504,568

(22) Filed: Aug. 14, 2006

(65) Prior Publication Data

US 2008/0036553 A1 Feb. 14, 2008

(51) Int. Cl.
*H01P 5/12* (2006.01)
*H01P 1/10* (2006.01)

(52) U.S. Cl. ..... 333/105; 333/262

(58) Field of Classification Search ..... 333/101, 333/102, 105, 106, 262
See application file for complete search history.

(56) References Cited

U.S. PATENT DOCUMENTS 4,031,345 A 6/1977 Garcia
4,206,332 A 6/1980 Veenendaal
4,399,439 A * 8/1983 Upadhyayula ..... 340/14.63
4,908,587 A * 3/1990 Davcev ..... 333/101
5,712,603 A * 1/1998 Kim et al. ..... 333/101
6,115,585 A * 9/2000 Matero et al. ..... 455/78
6,218,911 B1 * 4/2001 Kong et al. ..... 333/101
6,701,779 B2 3/2004 Volant et al.

* cited by examiner

*Primary Examiner*—Benny Lee
*Assistant Examiner*—Alan Wong
(74) *Attorney, Agent, or Firm*—Steven P. Koda

(57) ABSTRACT

In a multi-pole, double-throw switch, three multi-terminal device connectors are coupled to a printed circuit board, along with two header connectors and a movable array. A pcb trace electrically couples each terminal of each device connector to one or more corresponding contacts at the header connectors. The movable is movable between a first throw position in which a first header connector is engaged, and a second throw position in which a second header connector is engaged. In the first throw position, each terminal of a first of the three device connectors is electrically connected to a corresponding terminal of a second of the three device connectors. In the second throw position, each terminal of the first of the three device connectors is electrically connected to a corresponding terminal of a third of the three device connectors.

30 Claims, 11 Drawing Sheets

DVI-COMPATIBLE MULTI-POLE DOUBLE-THROW MECHANICAL SWITCH

FIELD OF THE INVENTION

This invention relates generally to the fields of mechanical switches, and more particularly to the field of multiple-pole switches.

BACKGROUND OF THE INVENTION

A switch may be described as having a pole and a throw. For example, a single-pole, single-throw switch may be used to turn a device on or off (e.g., a light, a vacuum cleaner, a television set.) The pole may be coupled, for example, to a source circuit (e.g., active power line), while a terminal for the throw may be coupled to a destination circuit (e.g., light bulb). In a double-pole switch, two source circuits may be coupled respectively to the 2 poles. For a double-pole, double throw switch, there are two terminals for each throw. For one throw, the 2 source circuits are coupled to a first set of 2 destination circuits. For the second throw, the 2 source circuits are coupled respectively to a second set of 2 destination circuits. This invention is directed to an economical and effective multiple-pole, double-throw switch.

SUMMARY OF THE INVENTION

The present invention provides a multi-pole, double-throw switch having a first plurality of n contacts, a second plurality of n contacts, a third plurality of n contacts, and a coupler. The coupler has a first position for electrically coupling 'n' respective contacts of the first plurality of contacts with 'n' corresponding contacts of the second plurality of contacts. The coupler has a second position for electrically coupling the 'n' respective contacts of the first plurality of contacts with 'n' corresponding contacts of the third plurality of contacts. The coupler is movable along a linear axis to move between the first position and second position.

The invention will be better understood by reference to the following detailed description taken in conjunction with the accompanying drawings.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

DETAILED DESCRIPTION OF ILLUSTRATIVE EMBODIMENTS

In the following description, for purposes of explanation and not limitation, specific details may be set forth, such as particular terminals, devices, components, techniques, protocols, interfaces, hardware, etc. in order to provide a thorough understanding of the present invention. However, it will be apparent to one skilled in the art that the present invention may be practiced in other embodiments that depart from these specific details. Detailed descriptions of well-known computers, terminals, devices, components, techniques, protocols, interfaces, and hardware are omitted so as not to obscure the description of the present invention.

Figure 1:
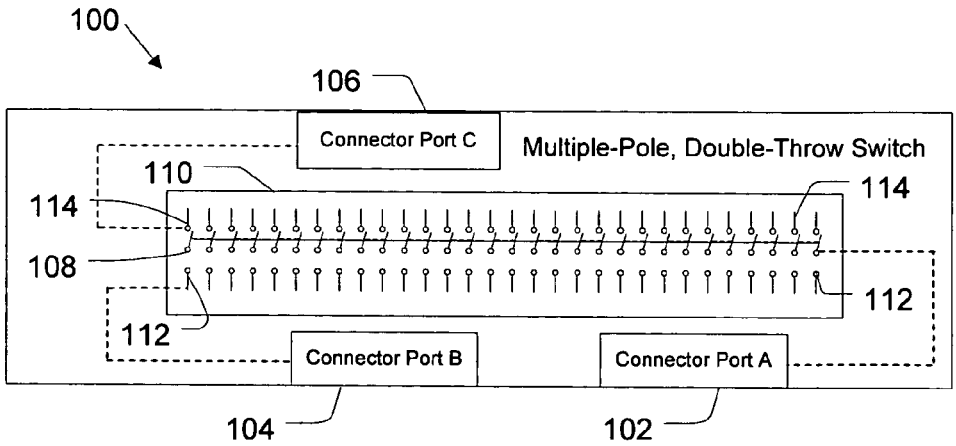
FIG. 1 is a block diagram and partial schematic of a multi-pole, double-throw switch according to an embodiment of this invention.

FIG. 1 shows a multiple-pole, double-throw switch 100 according to an embodiment of the invention. The switch 100 includes three connector ports 102, 104, 106 into which connectors for three respective devices may be received. A first device connects to the switch 100 at connector port 102. A second device couples to the switch 100 at connector port 104. A third device couples to the switch 100 at connector port 106.

The first connector port 102 includes a plurality of terminals. Each terminal is coupled to a corresponding terminal 108 of a multiple-pole switching circuit 110 (i.e., shown in schematic format). Each terminal 108 corresponds to a pole of the multiple-pole switching circuit 110. The second connector port 104 also includes a plurality of terminals. Similarly, the third connector port 106 includes a plurality of terminals. In a preferred embodiment for each terminal of the connector port 102, there is a corresponding terminal at each of the other connector ports 104, 106.

Each terminal of the second connector port 104 is coupled to a corresponding terminal 112 of the multiple-pole switching circuit 110. Similarly, each terminal of the third connector port 106 is coupled to a corresponding terminal 114 of the multiple-pole switching circuit 110. In a preferred embodiment the multiple-pole switching circuit 110 is a double throw switch having a neutral position and two throws. When the circuit 110 is positioned in the first throw each pole 108 of the circuit 110 is coupled to a corresponding terminal 112. When the circuit 110 is positioned in the second throw, each pole 108 of the circuit 110 is coupled to a corresponding terminal 114. Thus, in the first throw the circuit 110 couples each terminal of the first connector port 102 to a corresponding terminal of connector port 104. Correspondingly, the first device is electrically coupled to the second device. In the second throw the circuit 110 couples each terminal of the first connector port 102 to a corresponding terminal of connector port 106. Correspondingly, the first device is coupled to the third device. When the circuit 110 is in the neutral position, the poles 108 are not connected to either set of terminals 112, 114. Correspondingly, the first device is not coupled to either of the second device or third device.

Figure 2:
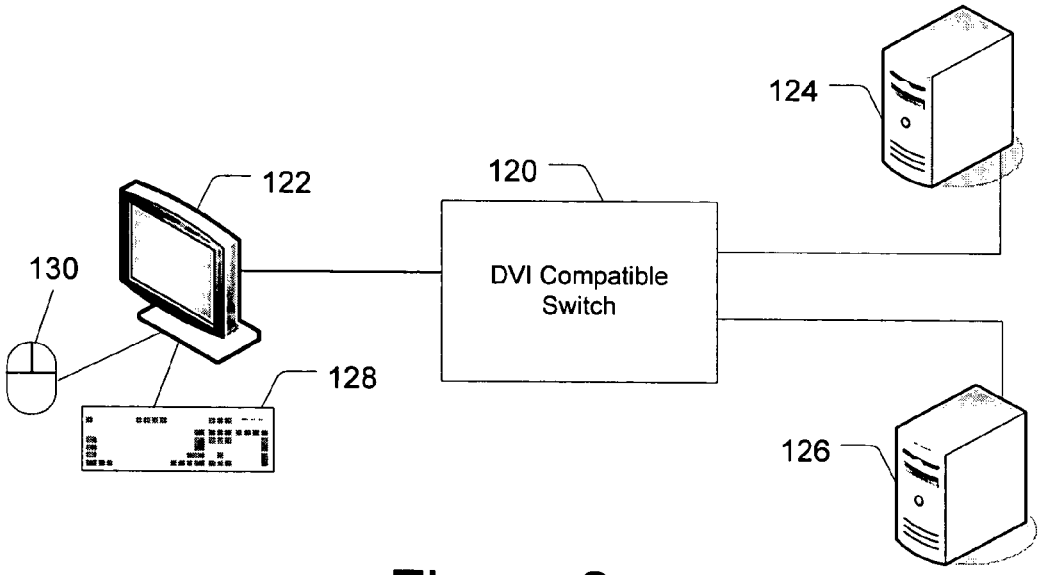
FIG. 2 is a block diagram of a DVI compatible switch coupling a display monitor to one of two computers.

FIG. 2 shows a multiple-pole double-throw switch embodied as a digital visual interface ("DVI") compatible switch 120. In an example configuration, a display monitor 120 may be coupled to either one of a first computing device 124 and a second computing device 126. For a computer monitor 120 having connectors which allow a keyboard 128 and a mouse 130 to be plugged into the monitor, the switch 120 also serves to connect the keyboard 128 and mouse 130 to either one of the first computing device 124 and the second computing device 126.

Figure 3:
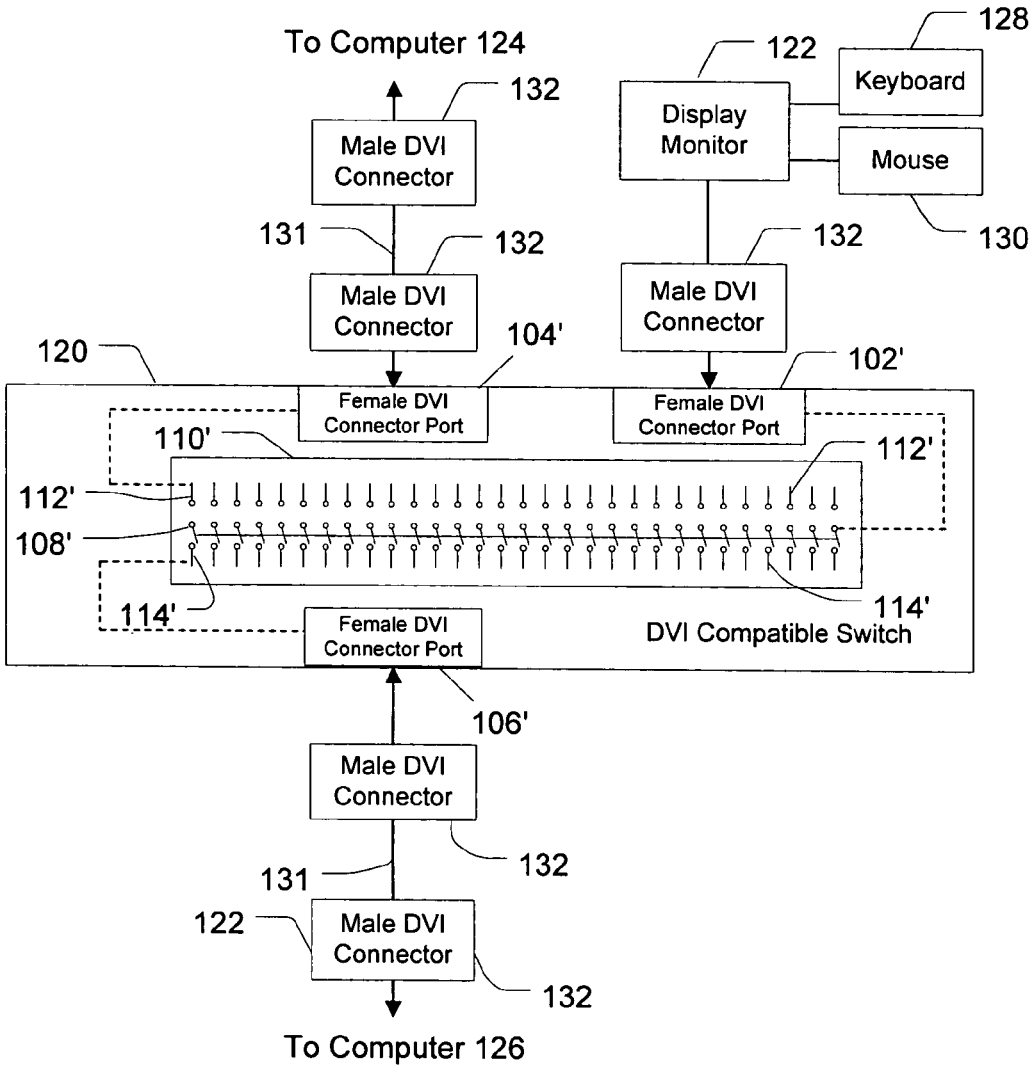
FIG. 3 is a block diagram and partial schematic of a DVI compatible switch with DVI cables for coupling to DVI compatible devices according to an embodiment of this invention.

Referring to FIG. 3, the display monitor 122 may have a DVI cable for coupling to a DVI connector at the DVI compatible switch 120. For example, the display cable may include a male DVI connector 132 which mates to a female DVI connector port 102' at the DVI compatible switch 120. Each of the computing devices 124, 126 also may include a DVI compatible cable 131 for coupling to the switch 120. For example, The cable 131 may include a DVI male connector 132 at each end. One DVI male connector 132 mates to a female DVI connector at the computing device 124, 126, while the DVI connector at the other end of the cable 131 may mate to a female DVI connector port 104', 106' at the DVI compatible switch 120. Thus, in an example configuration, the display monitor 122 couples to connector port 102', the computing device 124 couples to the connector port 104', and the computing device 106 couples to the connector port 106'.

The DVI compatible switch 120 may include a similar connection scheme as described above for the switch 100 of FIG. 1. Accordingly, each terminal of the second connector port 104' is coupled to a corresponding terminal 112' of the multiple-pole switching circuit 110'. Similarly, each terminal of the third connector port 106' is coupled to a corresponding terminal 114' of the multiple-pole switching circuit 110'. Preferably, the multiple-pole switching circuit 110' is a double throw switch having a neutral position and two throws. When the circuit 110' is positioned in the first throw each pole 108' of the circuit 110' is coupled to a corresponding terminal 112'. When the circuit 110' is positioned in the second throw each pole 108' of the circuit 110' is coupled to a corresponding terminal 114'. In the first throw the circuit 110' couples each terminal of the first connector port 102' to a corresponding terminal of connector port 104'. Correspondingly, the display monitor 122 (and in some embodiments the keyboard 128 and mouse 130) may be electrically coupled to the computing device 124. In the second throw the circuit 110' couples each terminal of the first connector port 102' to a corresponding terminal of connector port 106'. Correspondingly, the display monitor 122 (and in some embodiments the keyboard 128 and mouse 130) may be coupled to the second computing device 126. When the circuit 110' is in the neutral position, the poles 108' are not connected to either set of terminals 112', 114'. Correspondingly, the display monitor 122, keyboard 128 and mouse 130 are not coupled to either of the computing devices 124, 126.

The computing devices 124, 126 may be any of the types well known in the art, such as a mainframe computer, minicomputer, or microcomputer. Also, either one or both of the computing devices may be embodied as server computer, desktop computer, notebook computer, palmtop computer, tablet computer, game computer, or handheld computing device (e.g., cell phone; smart phone; personal digital assistant (PDA)).

Referring again to FIG. 1, in various embodiments different devices may be coupled to the switch 100. In the embodiments of FIG. 2 a display is coupled to either of two computing device. In another embodiment a computing device may be coupled to either of two displays. In other embodiments other peripherals may be coupled in a similar manner to one or more computing devices or other peripherals. In still other embodiments, other devices such as non-computing devices may be coupled to the switch 100. Although the embodiment of FIG. 2 depicts a DVI compatible switch 120, in other embodiments connectors of a different standard or format may be implemented to couple a device to the switch 100.

Figure 4:
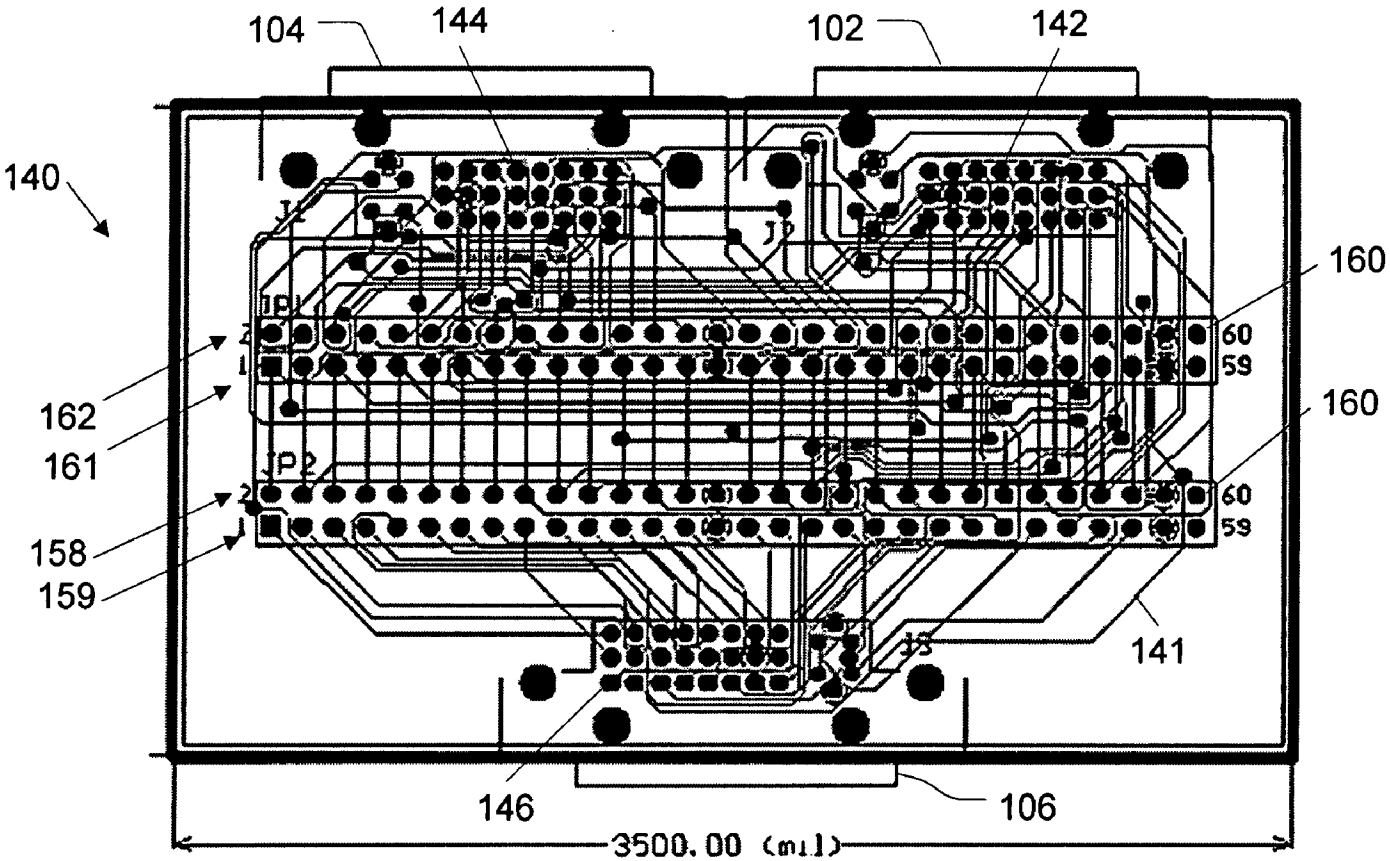
FIG. 4 is a printed circuit board layout for an exemplary embodiment of a printed circuit board component of a multi-pole, double-throw switch according to an embodiment of this invention.

The multiple-pole switching circuit 110 (110') may be implemented in various manners. Referring to FIG. 4, in some embodiments a printed circuit board 140 may be included to provide conductive traces 142 for connecting the connector ports 102, 104, 106 (102', 104', 106') to the switching circuit 110 (110'). For convenience the part numbers 102, 104, 106, 108, 110, 112 and 114 also used hereafter to also refer to the corresponding part numbers of the various embodiments, (e.g., 102', 104', 106', 108', 110', 112', and 114'). One of skill will appreciate that other ways of connecting the ports to the circuit 110 may be implemented, such as with wire leads, ribbon cables, integrated circuits, or other conductive or semiconductive signal paths.

Figure 5A:
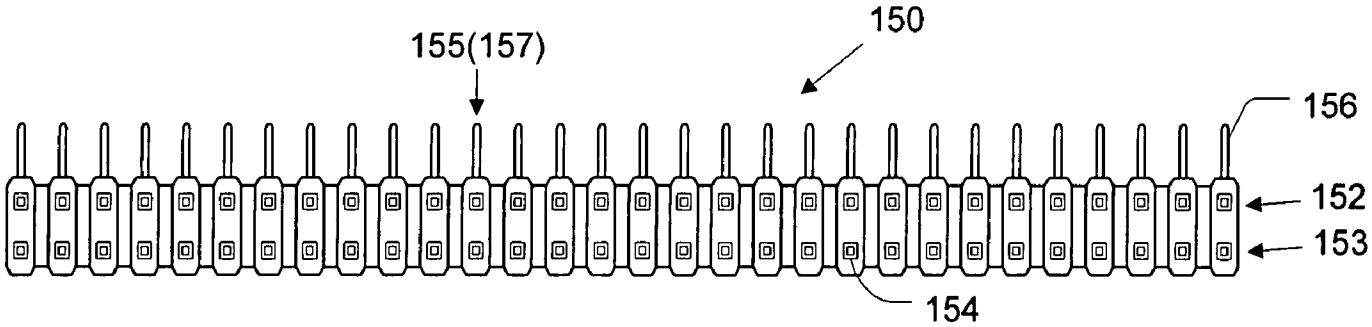
FIGS. 5A, B and C are isometric views of a right-angle header connector component for an exemplary embodiment of the multi-pole, double-throw switch according to an embodiment of this invention.
Figure 5B:
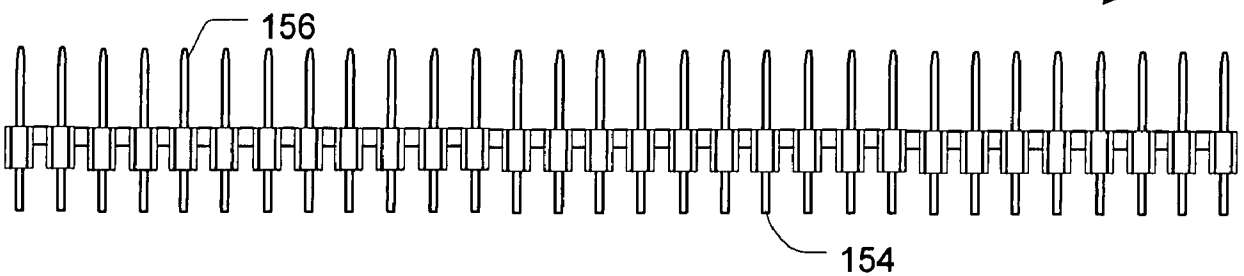
Figure 5C:
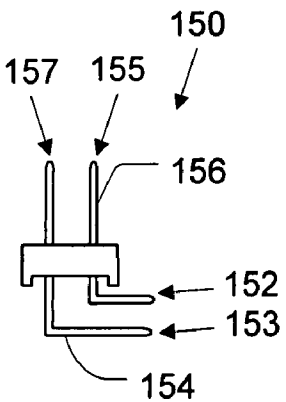

As shown in FIG. 4, the printed circuit board ("pcb" or "pc board") 140 may include openings 142 for receiving leads of the connector port 102, openings 144 for receiving leads of the connector port 104, and openings 146 for receiving leads of the connector port 106. In some embodiments the multiple-pole switching circuit 110 may include a pair of header connectors. For example, FIGS. 5A, 5B and 5C show a 60 pin right angle header connector 150 having 2 rows 152, 153 of 30 male pins 154. In addition, there is a lead 156 for each pin 154 aligned in 2 rows of leads 155, 157. For example, a conductor may have a first end embodying a pin 154 and a second end embodying a lead 156. Thus, a conductive path occurs from each pin 154 to its corresponding lead 156 of the connector 150. The printed circuit board 140 includes two rows 158, 159 of openings 160 to receive the leads 156 from the corresponding rows 155, 157 of one connector 150, and two rows 161, 162 of openings 160 to receive the leads 156 from the corresponding rows 155, 157 of another connector 150.

A DVI connector typically includes 29 pins/leads. In one embodiment each one of the 29 leads is coupled to a corresponding lead of a connector 150 via a conductive trace 141. In one embodiment, each lead from one connector port 102 is coupled to a corresponding lead in the row 155 of the leads 156 of one of the connectors 150, and also coupled to a corresponding lead in the row 155 of leads 156 of the other connector 150. Thus, the leads from the connector port 102 are coupled to two rows of openings 158 and 161 on the pc board 140. In such embodiment, each lead from another connector port 104 is coupled to a corresponding lead 156 in the row 157 of the leads of one connector 150, while each lead from still another connector port 106 is coupled to a corresponding lead in the row 157 of the leads 156 of the other connector 150. Thus, the leads from the connector port 104 are coupled to the row of openings 159 on the pc board 140, and the leads from the connector port 106 are coupled to the row of openings 162 on the pc board 140. Referring to the 4 rows 158, 159, 161 and 162, the openings 160 also form 30 columns, in which each one column includes four openings 160, one opening from each of rows 158, 159, 161, 162. In an embodiment the traces 141 may be arranged so that each column corresponds to the same pin number among the 29 pins of a DVI connector, (i.e., with one column left over as unused). Accordingly, to connect pin 1 of a first DVI connector plugged into a first connector port 102 to a corresponding pin 1 of a second DVI connector plugged into another connector port 106, the opening 160 at column 1 of row 158 is to be electrically coupled to the opening 160 at column 1 of row 159. Similarly, to connect the other pins of the first DVI connector (plugged into the connector port 102) to corresponding pin numbers of such other DVI connector (plugged into the connector port 106), the opening 160 at each given column of row 158 is to be electrically coupled to the opening 160 at each given column of row 159. In a similar manner, to connect each pin of the first DVI connector plugged into the connector port 102 to a corresponding pin number of the remaining DVI connector plugged into the connector port 104, the opening 160 at each given column of row 161 is to be electrically coupled to the opening 160 at each given column of row 162.

Figure 6:
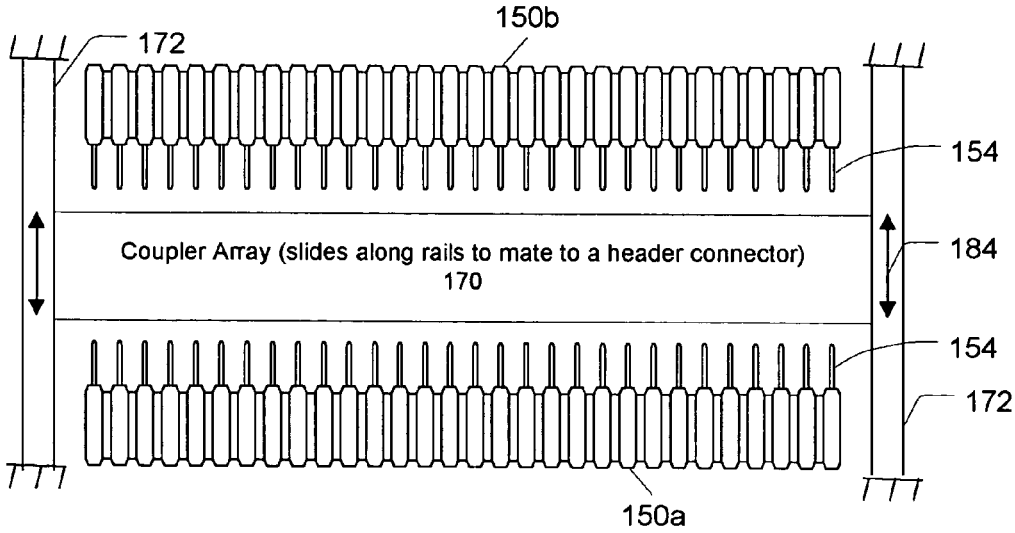
FIG. 6 is a partial view diagram of a multi-pole, double-throw switch according to an embodiment of this invention.
Figure 7:
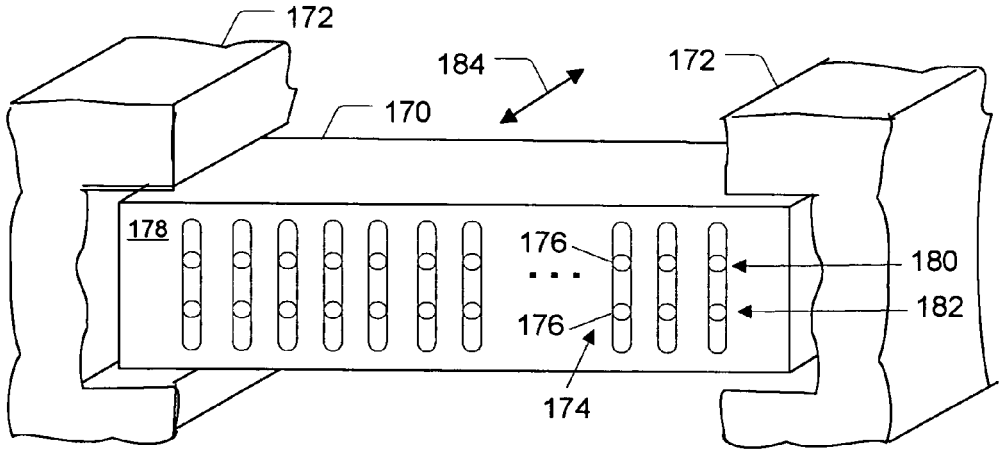
FIG. 7 is a partial view of an embodiment of a movable array movable along a pair of rails for a multi-pole, double-throw switch.

Referring to FIGS. 6 and 7 a movable coupler array 170 also may form a portion of the multiple-pole switching circuit 110. In an embodiment, the array 170 includes a plurality of conductive paths. A conductive path may include contacts 170 which engage the pins 154 of a header connector 150. For example, the two header connectors 150 may be mounted to the pc board 140 so that the pins 154 of one connector 150 face the pins 154 of the other connector 150. (see FIG. 6). On a face 178 of the array 170 aligned toward one connector 150, the array 170 may include two rows 180, 182 of contacts 176. One contact 176 from each row 180, 182 form a pair of contacts 174 for a given one of the plurality of conductive paths. In an embodiment, the coupler array may be one or more ganged shunt arrays in which a conductive path is formed between a given pair of contacts 174, while being isolated from the other contact pairs 174. For, example, the movable array 170 may include a set of 30 contact pairs 174 on one face 178, and include another set of 30 contact pairs 174 on another face, ( e.g., the face directed towards the other connector 150). Thus, in an embodiment 30 shunts may be aligned toward one of the header connectors 150, while another 30 shunts are aligned toward the other header connector 150.

In some embodiments the contacts in row 180 on array face 178 are aligned in a common plane with contacts 176 on an opposite face. In the same plane may be one row 153 of pins from each of two header connectors 150. Similarly, contacts in row 182 of array face 178 are aligned with contacts on an opposite array face and with one row 152 of pins 154 from each of two header connectors 150. In another embodiment, the contacts in row 180 on face 178 may be in one plane formed with the pins of row 153 of one connector 150, while the contacts in a row 180 on the opposite array face may be in a different plane with the pins of row 153 of another connector. Similarly, the contacts in rows 182 on opposite faces of the array 170 may be in different planes. In such other embodiment the two header connectors mating to the array 170 may be in different planes relative to the pcb 140.

In some embodiments the coupler array 170 is movable along a rail or track 172. When the coupler array is moved toward one header connector 150, each contact pair 174 may engage a corresponding pair of pins 154 of the connector 150. Thus, a pin 154 in one row and a corresponding pin 154 in another row engage the contacts 176 of a corresponding contact pair 174. Such engagement creates a conductive path coupling such pins 154 through the contact pair 176 (e.g., through a shunt). Similarly, each pin 154 in a given row of the header connector 150 is electrically coupled to its corresponding pin 154 in another row of the same header connector 150 by another of the shunts. This position corresponds to one throw of the double throw switching 120. It is to be noted that such a throw may be achieved in a single linear motion along a given axis 184, and results in a connection for each of the 30 poles 108 (see FIGS. 1 and 3) of the switching 120.

Figure 8:
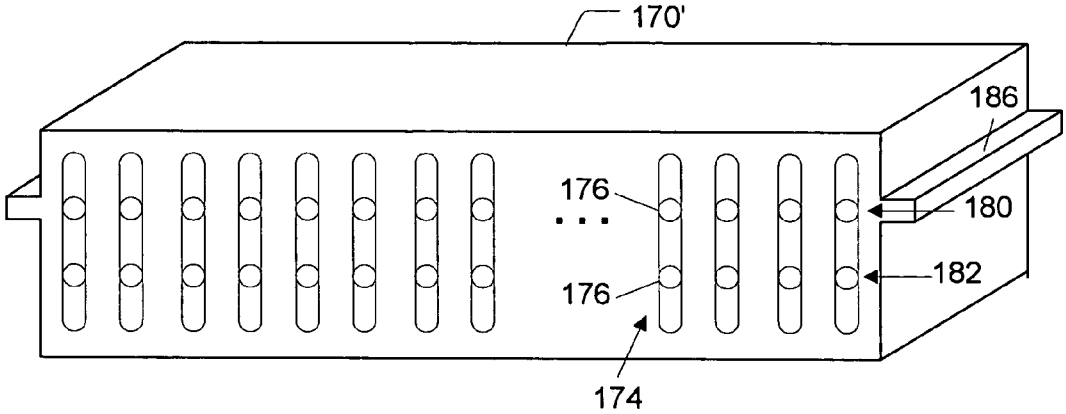
FIG. 8 is a perspective view of an embodiment of a movable array for a multi-pole, double-throw switch.

In an embodiment the rails 172 may be anchored to the pc board 140. The coupler array may have a shape allowing for a user to grip the array to achieve a desired linear motion. For example, a handle 188 (see FIG. 9) may be mounted to, integral to, or otherwise affixed to the array 170. The array 170 may take various shapes or have various appendages or fixtures to allow the array to move along the linear axis 184. In the embodiment of FIG. 7, edges of the array form a rail that may move along a track mounted to the pcb 140. Referring to FIG. 8, in another embodiment the movable array 170' may include edges 186 that protrude outward to engage tracks. In still other embodiments, the movable array may include a recess (not shown) that serves as a track for a fixed rail that may, for example, be mounted to the pcb 140.

Figure 9:
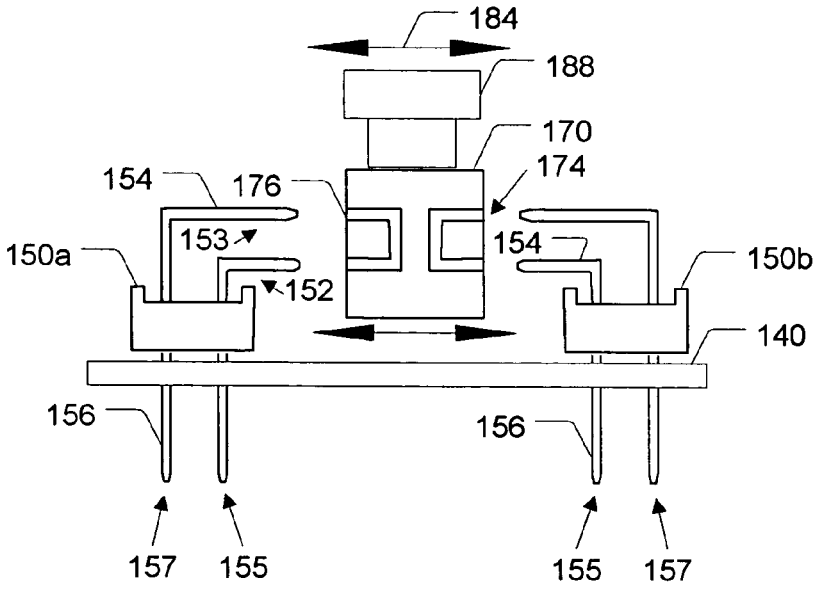
FIG. 9 is a diagram of components of the multi-pole, double-throw switch according to an embodiment of this invention, showing a movable shunt array which in a first position couples upper and lower pins of one header connector, and in a second position couples upper and lower pins of another header connector.

FIG. 9 shows an embodiment of the switching circuit 110, in which the movable array 170 includes female contacts 176 which receive corresponding male pins 154. The array 170 may move in one direction allowing contact pairs 174 to engage corresponding pins 154 of a header connector 150*a*. The array 170 also may move in another direction allowing contact pairs 174 to engage corresponding pins 154 of header connector 150*b*. In the embodiment illustrated the movable array 170 includes separate contact pairs 174 for mating to either of the header connectors 150*a* and 150*b*.

Figure 10:
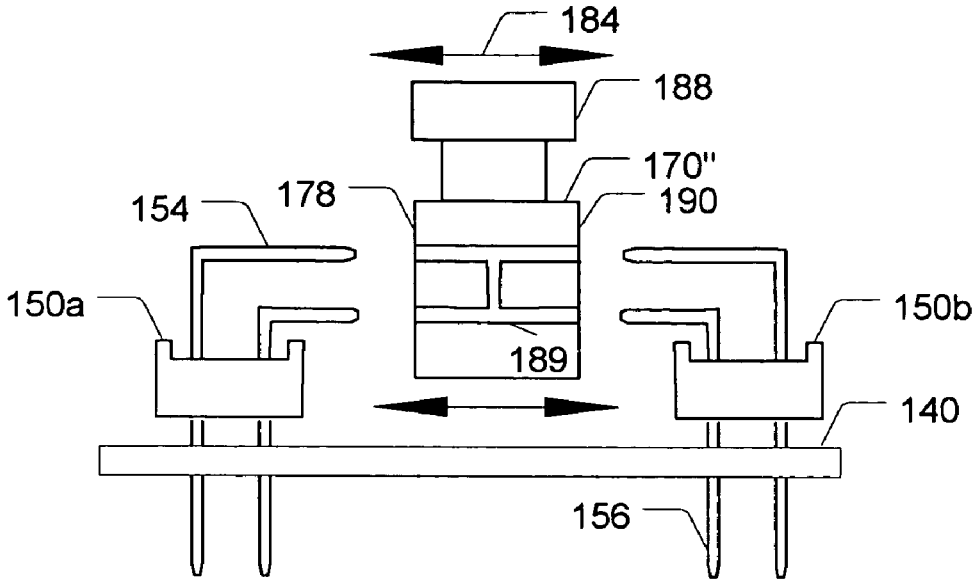
FIG. 10 is a diagram of components of the multi-pole, double-throw switch according to another embodiment of this invention, showing a movable shunt array.

FIG. 10 shows an embodiment of the switching circuit 110, in which the movable array 170" include a common shunt for mating at one time to one of either of the header connectors 150*a* and 150*b*. In such embodiment the movable array includes 30 shunts 189, each shunt having four contacts, two at face 178 and two at face 190.

Figure 11:
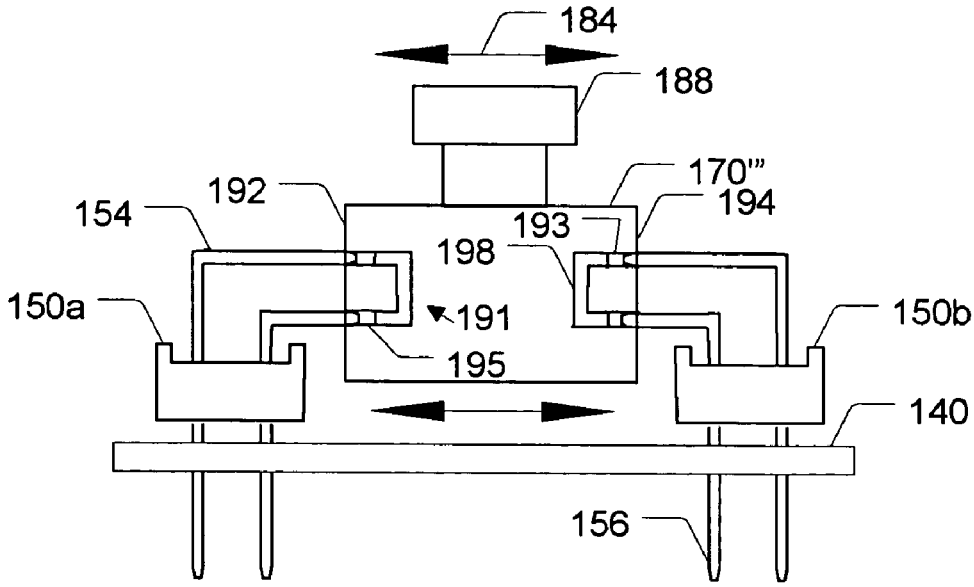
FIG. 11 is a diagram of components of the multi-pole, double-throw switch according to yet another embodiment of this invention, showing a movable shunt array which partially engages each header while in either throw position.

FIG. 11 shows an embodiment of the switching circuit 110, in which the movable array 170''' is wide enough to engage concurrently pins 154 from each of the two header connectors 150*a*, 150*b*. The movable array includes a plurality of passages 191, in which each passage may connect two openings. Such two openings receive a corresponding two pins of one of the header connectors 150. Along a first portion 193 of the passage at one opening, the passage walls are formed by insulative material. Similarly along a second portion 195 of the same passage at the other opening, the passage walls also are formed with insulative material. Along a third portion 198 of the same passage connecting the first and second portions, the passage walls are formed with conductive material. In an embodiment there may be a separate passage 191 for each pair of pins 154. For example, to engage either of two 60-pin header connectors 150*a*, 150*b*, the array 170''' may include 30 passages 191 engaging the first connector 150*a* and 30 passages 191 engaging the second connector 150*b*. In another embodiment, the array may include multiple passages in which each passage has four openings, in a similar manner as shown in FIG. 10, although the passages have distal portions which are formed by insulating material and inner portions which are formed by conductive material, in a similar manner as shown in FIG. 11.

Still referring to FIG. 11, the movable array 170''' is shown in a neutral position in which neither the pins 154 from connector 150*a* nor the pins 154 from connector 150*b* penetrate into the passages 191 deep enough to engage the conductive portions 198 of the respective passages. As the array 170''' is moved linearly along the axis 184 in one direction, the conductive portion 198 of the passages 191 on one face 192 of the array engage the conductive pins 154 of the conductor 150*a*. Similarly, as the array 170''' is moved linearly along the axis 184 in the opposite direction, the conductive portion 198 of the passages 191 on the other face 194 of the array engage the conductive pins 154 of the conductor 150*b*. In some embodiments of the array 170''' a track and rail need not be included. In particular, the movable array 170''' is wide enough in such embodiment that when moved in one direction to achieve extreme engagement at one face 192 with one connector 150*a*, the pins of connector 150*b* still remain engaged with the insulative portion of the passage on the opposite face 194 of the array 170'''.

Figure 12:
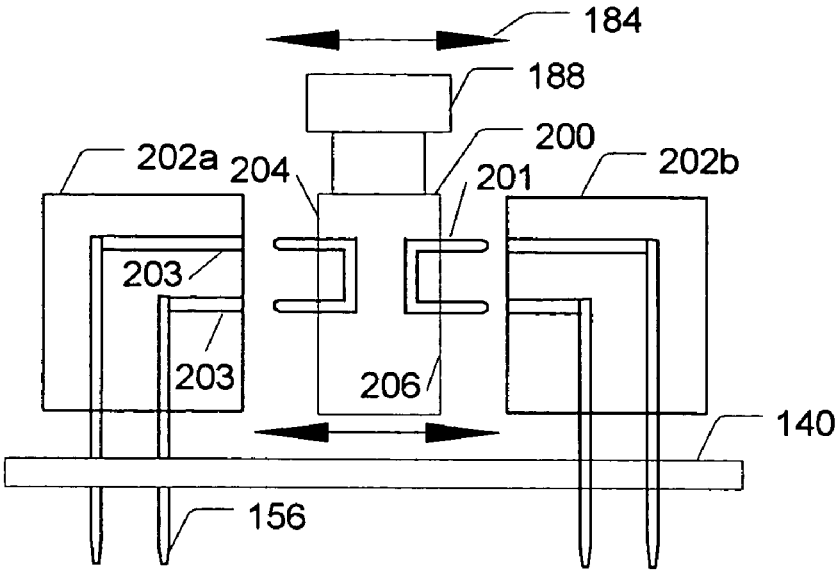
FIG. 12 is a diagram of components of the multi-pole, double-throw switch according to another still embodiment of this invention, showing a movable shunt array having male shunts and header connectors having female terminals.

FIG. 12 shows still another embodiment of the switching circuit 110 in which a movable array 200 includes male contacts 201 and header connectors 202*a, b* include female terminals 203. For example, the movable array may include 60 male pins on each of faces 204, 206 extending toward the female terminals of the header connectors. A pair of pins form a conductive path and may mate to a corresponding pair of female terminals. The movable array 200 may move in a similar manner as described above for other embodiments of the moveable array. The header connectors 202 may be formed in similar manner as the male header connectors shown in FIGS. 5A-C, although formed as female header connectors 202. The moveable array 200 may have separate male conductive paths on each face 204, 206 or may share a conductive path on both faces analogous to the embodiment shown in FIG. 10. Further the moveable array 200 may be wide enough to engage female terminals at both connectors 202*a, b* concurrently. In such embodiment the female terminals form passages analogous to those formed in the moveable array 170''' having distal portions which are formed with insulative walls and inner portions which are formed by conductive walls.

Figure 13:
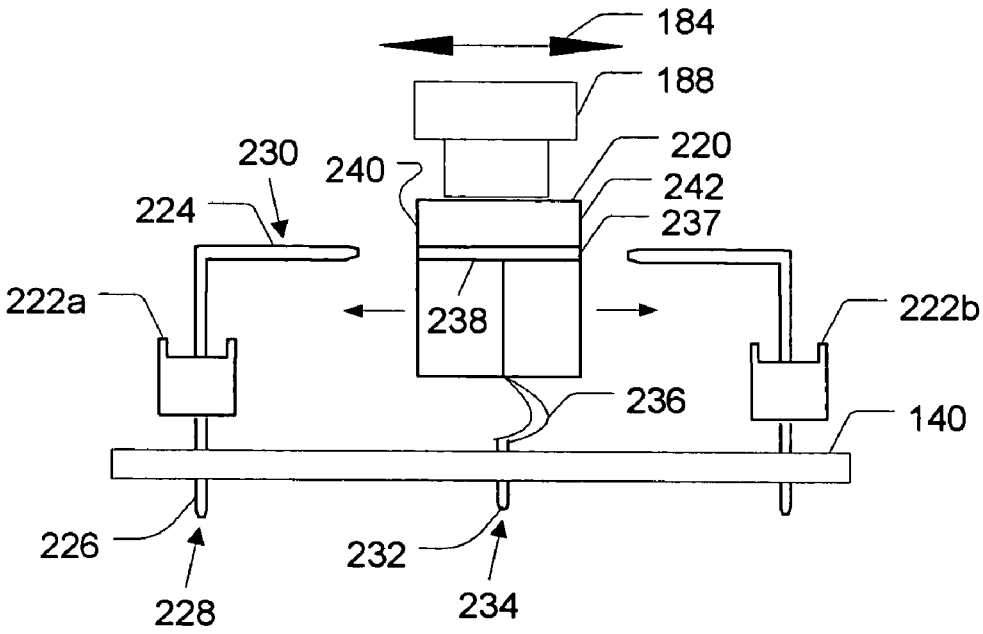
FIG. 13 is a diagram of components of the multi-pole, double-throw switch according to still another embodiment of this invention, showing two-single row header connectors and one movable connector.

FIG. 13 shows still another embodiment of a multiple-pole double throw switch in which the movable array is always coupled to one of the connector ports (e.g. connector port 102 see FIGS. 1 and 3). The movable array 220 moves into engagement with either one of a first connector 222*a* or a second connector 222*b*. The movable array 22 may include a plurality of leads 232 that may be affixed to the pcb 140. Traces along the pcb 140 may extend from each respective lead 232 to corresponding leads of the connector port 102. The leads 232 may be conductively coupled to a ribbon cable 236 or another flexible connection scheme that allows the array 220 to move while remaining mechanically connects to the leads 232. A given lead 232 extends to be coupled to a conductive path at each of two openings 237.

The moveable array 220 may include multiple openings 237 or pins on each face 240, 242 to mate with corresponding pins 224 or openings on the connectors 222*a,b* at each side of the array 220. In an embodiment the openings 237 may be aligned in a row to mate with pins 224 of a connector 222 similarly aligned in a row 230. The leads 226 of each connector 222 may be aligned in a row 228. Similarly, the leads 232 coupled to the array 22 may be aligned as a row 234. In the embodiment illustrated an opening 237 on one face 240 of the array 220 forms part of a passage 238 coupled to a corresponding opening 237 on the other face 242. Thus, one lead 232 leads to 2 openings—one at each face 240, 242 to mate with one corresponding pin 224 from either of the connectors 222*a*, 222*b*. in another embodiment the corresponding openings 237 may be coupled to the same lead 232 without forming a common passage. In still another embodiment the array may maintain engagement with both connectors while establishing electrical coupling with only one of connector 222 (e.g., in a manner analogous to that shown in FIG. 11).

In the various embodiments described the array 170 moves along a linear axis in a first direction to make concurrent contact with corresponding contacts (e.g., pins) of one connector, and moves in an opposite direction to make concurrent contact with corresponding contacts of another connector. The array 170 thus may concurrently disconnect with all contacts (e.g., pins 154) of one connector 150 at one given time, and concurrently connect with all contacts of another connector 150 at another given time. In some embodiments the array 170 moves perpendicular to a given row (e.g., 152, 153) of a connector 150 during the linear motion. In alternative embodiments, the connectors 150 (222) may move instead of the array 170 (220). Further, although the two connectors 150 which alternatively mate with the array 170 have been described as being of the same type, the connector 150 mating to one 178 of the array may differ from the connector 150 mating to another face of the array 170. Further, a given connector 150 may be formed by one or more components. For example, multiple connector components may be aligned to achieve the rows 152, 153 of pins 154 for connector 150.

In the various embodiments, the array 170 may move along a rail or tracks or move without guides—other than the pins 154 from the connectors 150 which may serve as guides. In still other embodiments, alternative guides may be implemented, such as ball bearings which run within a track or wheels which run along a linear path.

Figure 14:
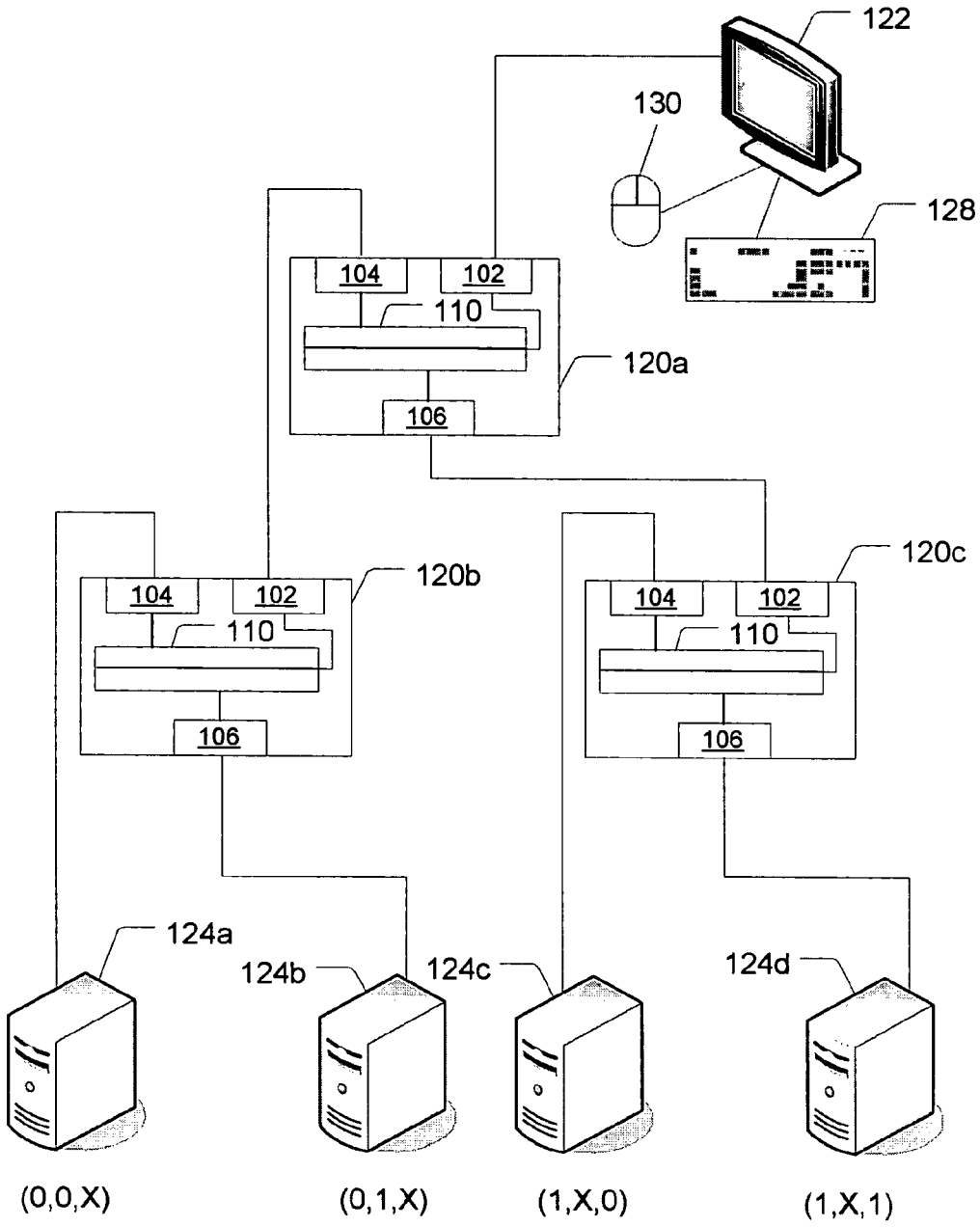
FIG. 14 is a diagram of multiple switches cascaded to couple a first device to one of a plurality of other devices.

In still other embodiments, the multiple-pole double-throw switch 120 may be connected to other switches 120 to form a cascaded multiple throw switch for coupling a first device to more than two other devices. Referring to FIG. 14, a first device, such as a display monitor 122 may be coupled to one connector port 102 of a first switch 120*a*. Connector port 102 is coupled to either one of ports 104, 106 of switch 120*a* via a switching circuit 110 as described above for other embodiments. Another switch 120*b* is connected to switch 120*a* by connecting port 102 of switch 120*b* to one of the other ports 104, 106 of switch 120*a*. Connected to the other port 106, 104 of switch 120*a* is another device or another switch 120*c*. Switch 120*c* is coupled to switch 120*a* by connecting port 102 of switch 120*c* to the other port 106, 104 of switch 120*a*. Coupled to the other ports 104, 106 of switch 120*b* may be one or more devices and/or one or more other switches 120. Similarly coupled to the other ports 104, 106 of switch 120*c* may be one or more devices and/or one or more other switches 120. In the embodiment illustrate there are two levels of coupling. In other embodiment additional levels may be coupled by coupling additional switches to switches 120*b* and *c*, rather than devices. At any given level a switch 120 may make two either of two connections corresponding to the two throws. Either connection may be to a device or a switch.

In the embodiment illustrated three switches 120*a,b,c* are coupled together, allowing a first device to be coupled to any one or four other devices. For example a display 122 may be coupled to any one of four computers 124*a,b,c,d*. In effect the three switches 120*a,b,c* provide a binary addressing scheme for selecting which one of the devices 124 is to be connected with device 122. For example, for a three digit binary code in which the first digit corresponds to the throw of switch 120*a*, the second digit corresponds to the throw of switch 120*b* and the third digit corresponds to the throw of switch 120*c*, varying addresses correspond to selection of the various devices 124. Address (0,0,X) corresponds to selection of device 124*a*. Address (0,1,X) corresponds to selection of device 124*b*. Address (1,0,X) corresponds to selection of device 124*c*. Address (1,1,X) corresponds to selection of device 124*d*. In each address x in the third digit designates that the throw of switch 120*c* does not effect the selection, and x in the second digit designates that the throw of switch 120*b* does not effect the selection. Thus, X can be either a 1, 0 or open. Open means that the switch is positioned in a neutral position so that a port 102 is not connect to either of the same switch's ports 104, 106. Varying addressing schemes may be implemented according to the connection scheme for coupling the multiple switches 120.

Figure 15:
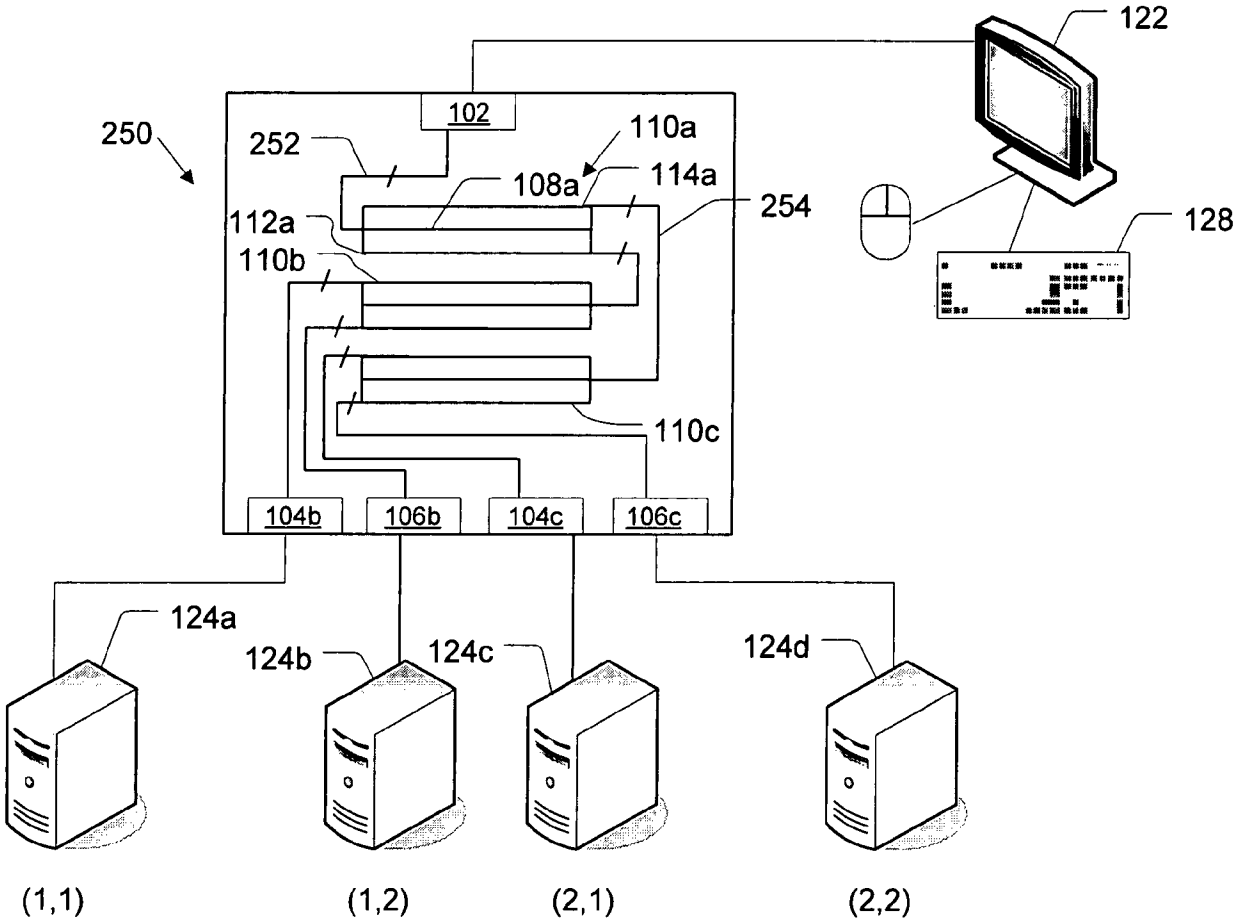
FIG. 15 is a diagram of a multiple-pole multiple-throw switch having a plurality of switching circuits in cascade allowing a first device to be coupled to one of a plurality of other devices.

Referring to FIG. 15, rather than cascade multiple switches 120, a switch 250 may include multiple switch circuits 110 to accomplish substantially the same result. For example, the switches 120*a,b,c* may be coupled together by cables to achieve the embodiment of FIG. 14, whereas the embodiment of FIG. 15 may be achieved by coupling switching circuits 110 on a pc board or other platform. Accordingly, switch 250 includes a port 102 to which a first device may be connected (e.g., by plugging a connector into the port 102). In addition, the switch 250 includes four additional ports 104*a*, 104*b*, 106*a*, 106*b* to which four other devices may be connected. The switch 250 includes three switching circuits 110*a,b,c*. Port 102 is coupled to the switching circuit 110*a*. The throw of switching circuit 110*a* corresponds to a first digit of a binary address. Ports 104*b* and 106*b* are coupled to the switching circuit 110*b*. The throw of switching circuit 110*b* corresponds to a second digit of a binary address. Ports 104*c* and 106*c* are coupled to the switching circuit 110*c*. The throw of switching circuit 110*c* corresponds to a third digit of a binary address. The poles 108*a* of switching circuit 110*a* are coupled to port 102. The terminals 112*a* of circuit 110*a* are coupled to the poles 108 of circuit 110*b*. The terminals 114*a* of circuit 110*a* are coupled to the poles 108 of circuit 110*c*. The terminals 112 and 114 of circuits 110*b* and 110*c* are coupled to the ports 104*b*, 106*b*, 104*c*, 106*c*. In an embodiment the fixed coupling between the terminals and poles of the circuits 110*a, b, c* may be implemented be conductive traces, wires or other conductive or semiconductive structures 154. In other embodiment additional circuits 110 may be included to expand the addressing capability for selecting to connect a first device 122 among additional devices 124.

In some embodiments the first device 122 connects to the first connector port 102, a second device 124 connects to the second connector port 104 and a third device connects to the third connector port 106. Each of the connector ports include a plurality of contacts (e.g., male or female). The switch couples the first device 122 to one of either the second device 124 or third device 126 depending on the throw of the switch 120. When a connection is made, each contact (e.g., pin) at the first connector port 102 is in electrical communication with a corresponding contact (e.g., pin). In some embodiments such electrical communication is achieved by an electrical path formed only by conductors, and excludes any amplifiers, filters and semiconductors. In other embodiments such electrical communication is achieved by an electrical path which may also include one or more amplifiers, filters or semiconductor devices.

Figure 16:
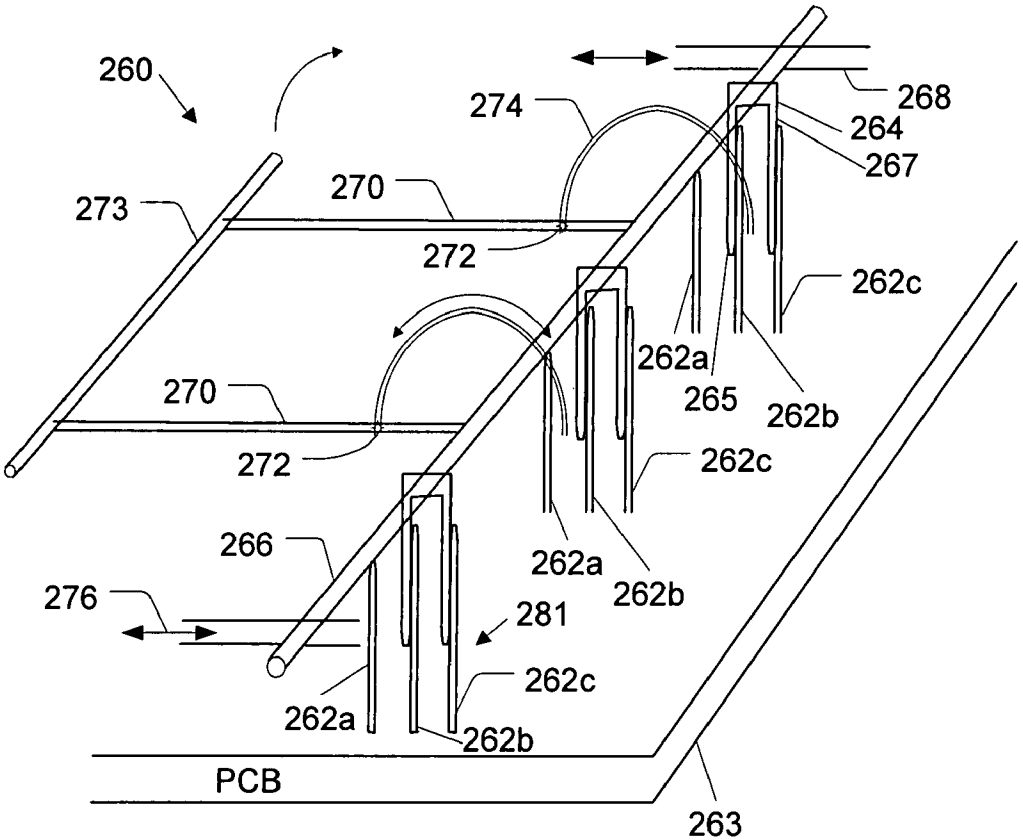
FIG. 16 is a diagram of another embodiment of a multiple-pole double-throw switch according to an embodiment of this invention.

Referring to FIG. 16, in another embodiment 250 of the switching circuit 110 of multiple-pole double-throw switch 100 (see FIG. 1), three sets of contacts 262*b*, 262*a*, 262*c* correspond to the sets of terminals 108, 112, 114. For example, each set of contacts may include a plurality of male pins, where each contact 262*a* is part of one set; each contact 262*b* is part of another set; and each contact 262*c* is part of still another set. In the illustrated embodiment the pins 262 protrude upward from a printed circuit board 263, although the orientation may vary in differing embodiments. Preferably there is at least one contact in each corresponding set for each of the n-poles in an n-pole double throw switch. One contact 262*a,b,c* from each set are grouped together in a group 281. The switch includes 2 throws. In a first throw, for each group 281, each contact 262*b* is coupled to a corresponding contact 262*a*. In the second throw, for each group 281, each contact 262*b* instead is coupled to a corresponding contact 262*c*.

Corresponding to each group 281 is a conductive coupler 264. The conductive coupler 264 moves along a linear axis 276 to move between a first position corresponding to the first throw and a second position corresponding to the second throw. Each coupler 264 is mechanically linked to a common support 266. For example, the common support 266 may be a bar. A lever 270 having a handle 273 is mechanically coupled to the support 266. In one embodiment the lever 270 includes a notch guide 272 which moves within a track 274. The track 274 is shaped in such a manner as to move the common support 266 within another track 268 along the linear axis 276. Specifically, as the lever 270 moves about an arc defined by the track 274, a corresponding linear motion is asserted upon the common support 266 to move along an axis 276 defined by the track 268.

Figure 17:
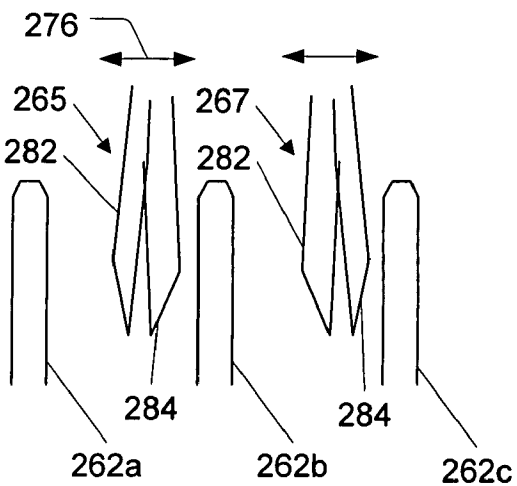
FIG. 17 is a diagram of a set of contacts and a corresponding coupler for an embodiment of the multiple-pole multiple-throw switch.

Referring to FIG. 17, each conductive coupler 264 includes two legs 265, 267. There is a conductive coupler 264 for each group 281 of contact 262. While the switch is in the first throw position, the leg 265 is in electrical communication with a corresponding pin 262, while the leg 267 is in communication with a corresponding pin 262*b*. While the switch is in the second throw position (as shown in FIG. 16), the leg 265 is in electrical communication with a corresponding pin 262*b*, while the leg 267 is in electrical communication with a corresponding pin 262*c*.

In some embodiments each leg 265, 267 may include a pair of contacts 282, 284. The contacts 282 establish physical communication with the pins 262*a, b* while the switch is in the first throw position. The contacts 284 establish physical communication with the pins 262*b,c* while the switch is in the second throw position. During a relaxed state between throw positions, each contact 282, 284 may have an angled orientation relative to an orientation of the corresponding pins 262, (i.e., contacts 282, 284 may be splayed so as not to be parallel to the corresponding pins while relaxed). Further, each contact 282, 284 may have a degree of flexion. As the switch is thrown by moving the lever 270, for example toward the first throw position, the contacts 282 meet the pins 262*a,b*. When completely in the first throw position, the contacts 282 flex to obtain good physical and electrical communication with the pins 262*a,b*. One of skill will appreciate that in other embodiments each leg 265, 267 may be formed by one contact which makes communication with one pin (e.g. 262*a*) during one throw and another pin (e.g., 262*b*) during another throw.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. The invention is intended to extend to all functionally equivalent structures, methods and uses, such as are within the scope of the appended claims. Those skilled in the art, having the benefit of the teachings of this specification, may affect numerous modifications thereto and changes may be made in form and details without departing from the scope and spirit of the invention.

What is claimed is:

1. An n-pole double-throw switch, comprising:

a first plurality of n contacts;

a second plurality of n contacts;

a third plurality of n contacts;

a coupler array including a plurality of couplers and means for fixing location of each coupler relative to the plurality of couplers, the coupler array having a first position for electrically coupling 'n' respective contacts of the first plurality of contacts with 'n' corresponding contacts of the second plurality of contacts, and having a second position for electrically coupling the 'n' respective contacts of the first plurality of contacts with 'n' corresponding contacts of the third plurality of contacts, wherein the fixing means moves along a linear axis to move the array between the first position and second position.

2. The switch of claim 1, wherein the fixing means comprises a support linked to the plurality of couplers.

3. The switch of claim 1, wherein the fixing means comprises a housing for the plurality of couplers.

4. The switch of claim 1, further comprising a lever which moves along a nonlinear path; and means for translating the nonlinear movement of the lever into a linear movement of the coupler array.

5. The An n-pole double-throw switch, comprising:

a first plurality of n contacts;

a second plurality of n contacts;

a third plurality of n contacts;

a coupler having a first position for electrically coupling 'n' respective contacts of the first plurality of contacts with 'n' corresponding contacts of the second plurality of contacts, and having a second position for electrically coupling the 'n' respective contacts of the first plurality of contacts with 'n' corresponding contacts of the third plurality of contacts, wherein the coupler is movable along a linear axis to move between the first position and second position; and means for guiding the coupler along a linear path.

6. The switch of claim 5, further comprising a lever which moves along a nonlinear path; and means for translating the nonlinear movement of the lever into a linear movement of the coupler.

7. A multi-pole switching apparatus having a mechanical throw, comprising:

a first connector having a first plurality of contacts and a second plurality of contacts, wherein for each one pole of the multiple-pole switch there is contact among the first plurality of contacts and a corresponding contact among the second plurality of contacts of the first connector;

a second connector having a first plurality of contacts and a second plurality of contacts, wherein for each one pole of the multiple-pole switch there is contact among the first plurality of contacts and a corresponding contact among the second plurality of contacts of the second connector; and a conductor array having a plurality of conductive paths, each one path of the plurality of conductive paths having multiple contacts, wherein for each one pole of the multiple-pole switch there is at least one conductive path among the plurality of conductive paths;

wherein at least one of the conductor array, first connector and second connector are movable;

wherein the switching apparatus has a first throw in which contacts at the conductor array are brought into electrical communication with the first connector in manner bringing each one contact of the first plurality of contacts of the first connector into electrical communication with said each one contact's corresponding contact of the second plurality of contacts of the first connector;

wherein the switching apparatus has a second throw in which contacts at the conductor array are brought into electrical communication with the second connector in a manner bringing each one contact of the first plurality of contacts of the second connector into electrical communication with said each one contact's corresponding contact of the second plurality of contacts of the second connector;

wherein a change of the switching apparatus between the first throw and the second throw is achieved by a linear motion.

8. The switching apparatus of claim 7, in which the conductor array is a movable array and wherein the first switch connector and second switch connector are fixedly positioned, said change of the switching apparatus between the first throw and the second throw being achieved by a linear motion of the conductor array.

9. The switching apparatus of claim 7, in which said change of the switching apparatus between the first throw and the second throw is achieved without moving the conductor array.

10. The switching apparatus of claim 7, wherein further comprising:

a first device connector having a first plurality of terminals for coupling to a first device and having a second plurality of terminals coupled to said first connector and said second connector;

a second device connector having a first plurality of terminals for coupling to a second device and having a second plurality of terminals coupled to said first connector; and a third device connector having a first plurality of terminals for coupling to a third device and having a second plurality of terminals coupled to said first connector.

11. The switching apparatus of claim 10, wherein the first device connector comprises a DVI connector, the second device connector comprises a DVI connector and the third device connector comprises a DVI connector.

12. The switching apparatus of claim 7, in which the conductor array comprises a movable shunt array comprising a linear row of first shunts, wherein there is a first shunt among the linear row of first shunts for each conductive path which engages the first connector.

13. The switching apparatus of claim 12, wherein there is a second shunt among the shunt array for each conductive path which engages the second connector.

14. The switching apparatus of claim 12, wherein each one first shunt of the shunt array has a first position forming an electrical path to corresponding contacts of the first connector and a second position in which an open circuit occurs to between the corresponding contacts of the first switch connector.

15. The switching apparatus of claim 12, wherein each one first shunt of the shunt array has a first position forming an electrical path to corresponding contacts of the first connector and a second position forming an electrical path to corresponding contacts of the second connector, and a neutral position in which an open circuit occurs at each of the first switch connector and second switch connector.

16. The switch of claim 15, further comprising a rail and track, wherein one of the rail and track is anchored and the other of the rail and track is carried with the conductor array allowing the array to slidably move between the first position, said second position, and said neutral position.

17. The switching apparatus of claim 12, wherein the conductor array is part of a housing which moves between the first position and the second position, wherein for each shunt of the shunt array the housing includes a pair of openings and a channel coupling the pair of openings, wherein along a first portion of the channel adjacent to one of the pair of openings, walls of the first portion are nonconductive, wherein along a second portion of the channel adjacent to the other of the pair of openings, walls of the second portion are nonconductive, wherein along a third portion of the channel connecting the first portion and second portion, walls of the third portion are conductive, said third portion forming said conductive path for a given shunt, wherein while the shunt array is in the first position the walls of the third portion of the channel are in electrical communication with a contact of the first plurality of contacts of the first connector and with a contact of the second plurality of contacts of the first connector.

18. The switching apparatus of claim 7, further comprising a rail and track, wherein one of the rail and track is anchored and the other of the rail and track is carried with the conductor array allowing the array to slidably move between said first position and said second position.

19. The switching apparatus of claim 7, in which the conductor array moves relative to a plurality of bearings to move between the first position and second position.

20. The switching apparatus of claim 7, further comprising a printed circuit board to which the first conductor and second conductor are mounted.

21. The switching apparatus of claim 7, in which the first connector comprises a right angle header connector having two rows of contacts, and wherein the conductor array comprises an array of shunts, wherein each one of a first plurality of shunts have a pair of contacts aligned to engage a contact from a first row of said first header connector contacts and a contact from a second row of said first header connector contacts.

22. The switching apparatus of claim 7, in which the first plurality of contacts of the first connector are linearly aligned in a first row and the second plurality of contacts of the first connector are linearly aligned in a second row generally parallel to the first row.

23. The switching apparatus of claim 7, wherein the first connector, second connector and conductive array form a switching circuit, the switching apparatus comprising plurality of said switching circuits, wherein a first device to be coupled to a first connector of one of the switching circuits may be selectively coupled to a plurality of other devices based upon a throw position of one or more switching circuits of the plurality of switching circuits.

24. The switching apparatus of claim 7, wherein a first device is electrically coupled to the conductor array, a second device is coupled to the first connector and a third device is coupled to the second connector, and wherein the first device is coupled to either one and not both of the second device and third device based upon a throw position of the switching apparatus.

25. A multi-pole switch, comprising:

a printed circuit board having a plurality of conductive traces;

a first device connector coupled the printed circuit board, the first conductor having a plurality of terminals respectively coupled to a plurality of first conductive traces of the printed circuit board;

a second device connector coupled the printed circuit board, the second conductor having a plurality of terminals respectively coupled to a plurality of second conductive traces of the printed circuit board;

a third device connector coupled the printed circuit board, the third conductor having a plurality of terminals respectively coupled to a plurality of third conductive traces of the printed circuit board;

a movable connector coupled to the printed circuit board, the movable connector having a plurality of terminals respectively coupled to the plurality of first conductive traces;

a first header connector coupled to the printed circuit board, the first header connector having a plurality of terminals respectively coupled to the plurality of second conductive traces;

a second header connector coupled to the printed circuit board, the second header connector having a plurality of terminals respectively coupled to the plurality of third conductive traces;

wherein the movable connector has a first position for engaging the first header connector with the plurality of first conductive traces being electrically coupled to the plurality of second conductive traces, and a second position for engaging the second header connector with the plurality of first conductive traces being electrically coupled to the plurality of third conductive traces.

26. The switch of claim 25, further comprising a rail and track, wherein one of the rail and track is anchored and the other of the rail and track is carried with the movable connector allowing the movable connector to slidably move between said first position and said second position.

27. A multi-pole switch having a mechanical throw, the switch comprising:

a printed circuit board having a plurality of conductive traces;

a first DVI connector coupled the printed circuit board, the first conductor having a plurality of terminals respectively coupled to a plurality of first conductive traces of the printed circuit board;

a second DVI connector coupled the printed circuit board, the second conductor having a plurality of terminals respectively coupled to a plurality of second conductive traces of the printed circuit board;

a third DVI connector coupled the printed circuit board, the third conductor having a plurality of terminals respectively coupled to a plurality of third conductive traces of the printed circuit board;

a first header connector coupled to the printed circuit board, the first header connector having a first plurality of terminals respectively coupled to the plurality of first conductive traces and a second plurality of terminals respectively coupled to the plurality of second conductive traces;

a second header connector coupled to the printed circuit board, the second header connector having a first plurality of terminals respectively coupled to the plurality of first conductive traces and a second plurality of terminals respectively coupled to the plurality of third conductive traces;

a movable array having a first position in which the first DVI connector is electrically coupled to the second DVI connector and having a second position in which the first DVI connector is electrically coupled to the third DVI connector, wherein each one of a plurality of poles of the multi-pole switch corresponds to a terminal of the first DVI connector.

28. The switch of claim 27, in which the movable array comprises a movable shunt array, wherein a first plurality of terminals of the first header connector are electrically coupled by respective shunts of the shunt array to the second plurality of terminals of the first header connector, and having a second position in which the first plurality of terminals of the second header connector are electrically coupled by respective shunts of the shunt array to the second plurality of terminals of the second header connector.

29. The switch of claim 27, wherein the movable array comprises a movable connector having a first position for engaging the first header connector with the plurality of first conductive traces being electrically coupled to the plurality of second conductive traces, and having a second position for engaging the second header connector with the plurality of first conductive traces being electrically coupled to the plurality of third conductive traces.

30. The switch of claim 27, further comprising a rail and track, wherein one of the rail and track is anchored and the other of the rail and track is carried with the movable array allowing the movable array to slidably move between said first position and said second position.

* * * * *